United States Patent [19]

Iino et al.

[11] 3,953,095

[45] Apr. 27, 1976

[54] ELECTRIC CONNECTION DEVICE HAVING ROTATABLE CONTACTS

[75] Inventors: Hiroyasu Iino, Ohmiya; Akira Seko; Harutoshi Tsujimura, both of Yokohama; Takashi Oka, Tokyo; Naoki Ogawa; Hiroshi Tsuda, both of Yokohama, all of Japan

[73] Assignee: Nissan Motor Company Limited, Yokohama, Japan

[22] Filed: May 20, 1975

[21] Appl. No.: 579,216

[30] Foreign Application Priority Data

May 27, 1974 Japan ..... 49-59809
May 28, 1974 Japan ..... 49-61520

[52] U.S. Cl. ..... 339/6 R; 339/277 R
[51] Int. Cl.[2] ..... H01R 39/00
[58] Field of Search ..... 339/6 R, 9 R, 277 R

[56] References Cited

UNITED STATES PATENTS 1,926,857 9/1933 Moister ..... 339/6 R X

*Primary Examiner*—Roy Lake
*Assistant Examiner*—DeWalden W. Jones

[57] ABSTRACT

The device for providing electric connection between a rotatable member and a stationary member has a doughnut-like housing of an insulating material and an annular and insulating base plate disposed in the housing coaxially and movably both in the circumferential and axial directions. Two annular contact plates are placed on a front face of the base plate, and two contact pins are held in the housing and urged always to stand on the contact plates, respectively, by means of compression springs. Both the housing and the base plate are locally shaped such that one of them can be fixed to the rotational member while the other can be engaged with the stationary member so as to be restrained from rotating together with the former.

8 Claims, 8 Drawing Figures

ELECTRIC CONNECTION DEVICE HAVING ROTATABLE CONTACTS

This invention relates to a device for providing electric connection and more particularly to a device for providing electric connection between an element mounted on a rotatable member and another element on a stationary member.

It is frequently needed for various apparatus to establish and maintain electric connection between a rotatable element and a stationary element. In the field of automobiles, for example, there are growing requirements for the installation of numerous electrically operated safety apparatus and not a few elements of these apparatus are installed on the instrument panel and/or the steering column. On the other hand, a free space between the steering wheel and instrument panel is rather made narrower as the result of prevalence of tilting steering columns. Therefore, a comparatively voluminous element as exemplified by an inflatable safety bag cannot be mounted on the steering wheel. A device for providing electric connection between an element which is rotated together with the steering wheel and another element such as an impact detector which is kept stationary on the vehicle body is naturally needed in such an installation plan.

There are various devices for electric connection between a rotating member and a stationary member. Most of them, however, have a quite minute construction and each is applicable to only certain articles of limited variations. Since numerous variations are demanded with respect to the construction and arrangement of the steering wheel and steering column for automobiles, there is strong need of a connecting device of the above-described type, which can be fabricated in various sizes and/or is applicable to any automobile regardless of variations in arrangements of the steering wheel and nearby stationary members.

It is therefore an object of the present invention to provide a device for providing electric connection between an element mounted on a rotatable member and another element on a stationary member, which device is reliable in function, resistant to humidity and dust and can easily be assembled with the members even when positional relationships between the rotatable and stationary members are varied to some extents.

According to the invention, a device for this purpose comprises a cylindrical housing of an insulating material with vacant cylindrical center, an annular base plate of an insulating material coaxially disposed in the housing in such an arrangement that the base plate is movable within the housing both in circumferential directions and in longitudinal axial directions, first and second annular contact plates spaced from each other and placed fixedly and coaxially on a first face of the base plate, first and second contact pins which are disposed in the housing in such an arrangement that the two contact pins are in contact with the two contact plates, respectively, and extend therefrom substantially perpendicularly to the contact plates, and means for urging the contact pins to be always pushed against the contact plates even when the base plate moves within the housing. The housing is locally shaped and the base plate has at least one vertical arm extending outwardly of the housing such that either the housing or the base plate can be fixed to a separate and rotatable member while the other can be engaged with a separate and stationary member such that the latter one is restrained from rotating together with the former one.

The housing has preferably at least one locally and axially projecting hollow projection in such an arrangement that the contact pins are held therein and kept pushed against the contact plates by means of compression springs installed in the projection.

The invention will be fully understood from the following detailed description of preferred embodiments thereof with reference to the accompanying drawings, in which.

Figure 1:
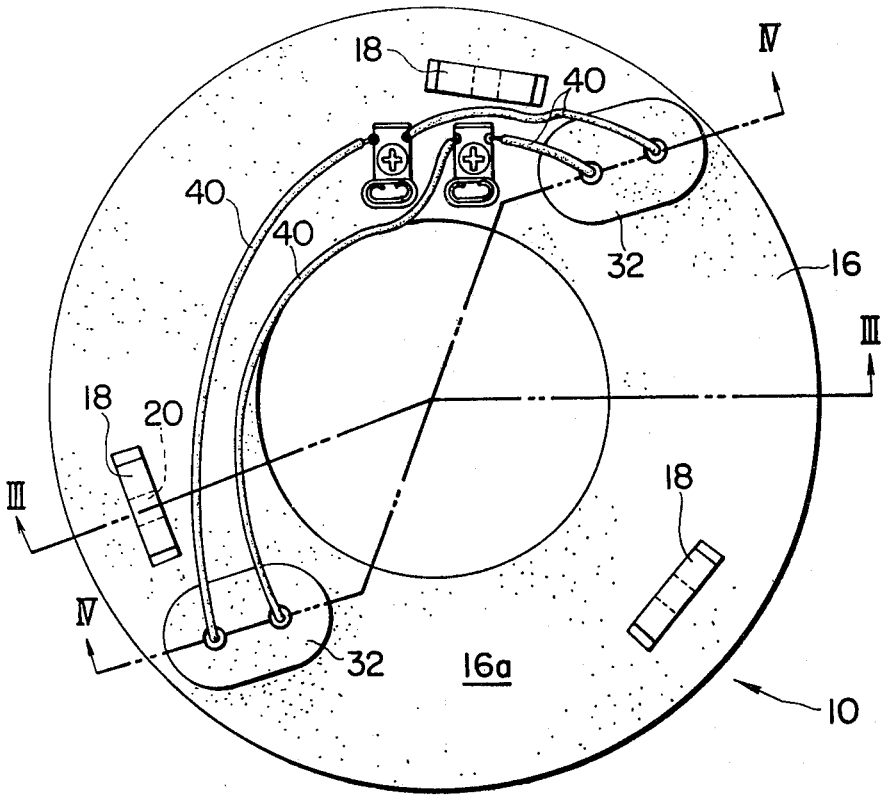
FIG. 1 is a front view of a rotary connector embodying the invention.
Figure 3:
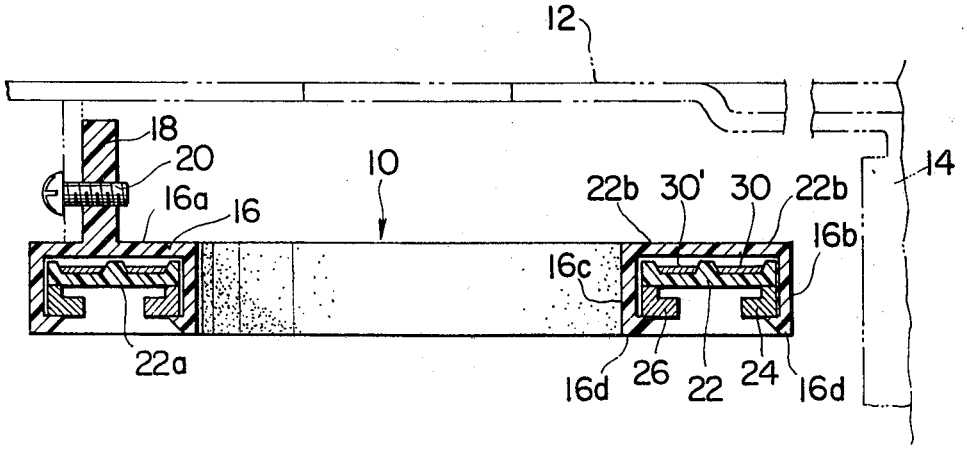
Figure 4:
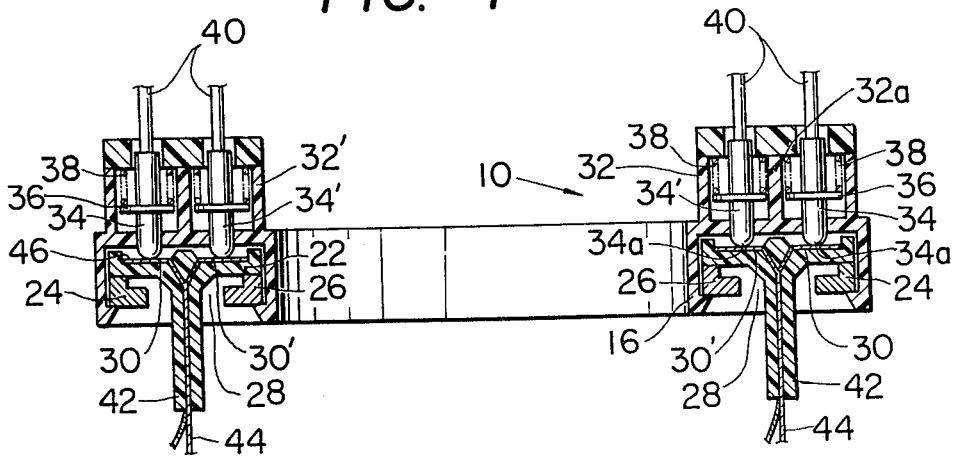
Figure 5:
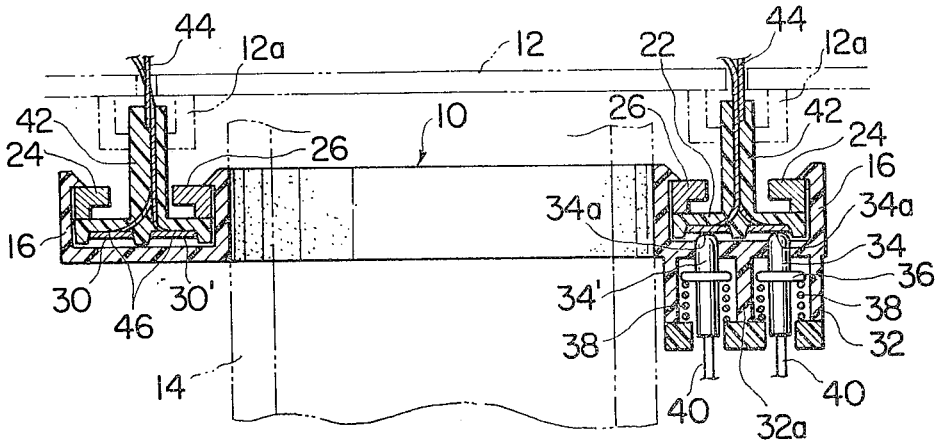
Figure 6:
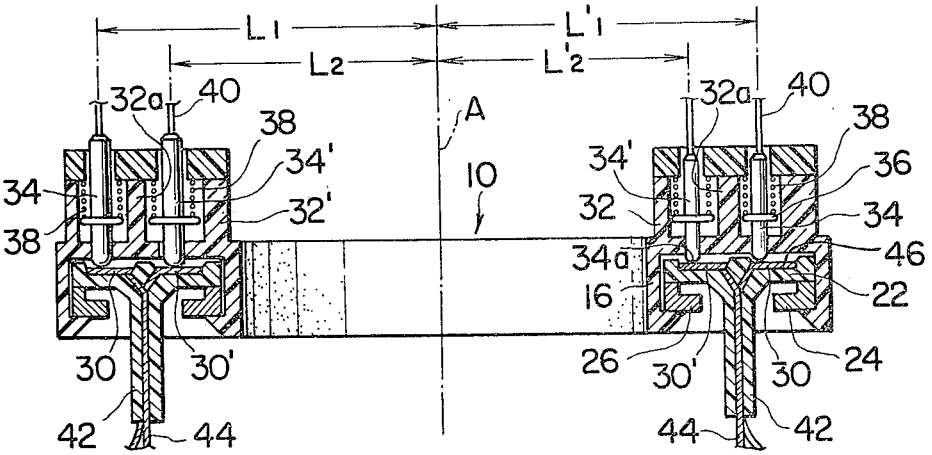

FIGS. 3 and 4 are sectional side views of the same connector taken along the lines 3 — 3 and the line 4 — 4 of FIG. 1, respectively;

FIG. 5 is fundamentally the same view as FIG. 4 but shows a reversed arrangement with respect to rotatable and stationary members with which the connector is assembled;

FIG. 6 is a similar view to FIG. 4 but shows a slightly modified connector as another embodiment of the invention.

Figure 7:
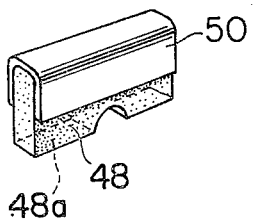
Figure 8:
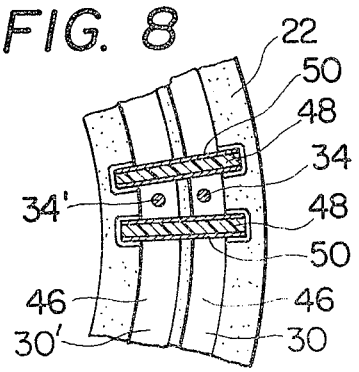

FIG. 7 is a perspective view of a scraper which serves as an auxiliary element for the connectors according to the invention; and FIG. 8 is a partially exploded and fragmentary front view of a connector according to the invention, which is fundamentally similar to the one of FIGS. 1 – 4 but additionally provided with the scraper of FIG. 7.

Figure 2:
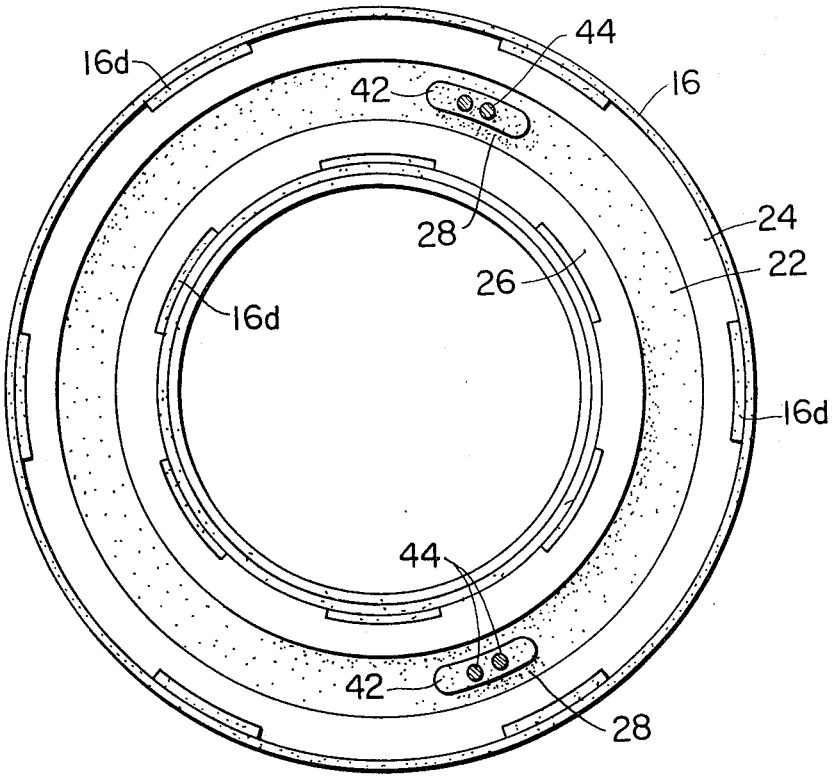
FIG. 2 is an end view of the same connector.

As a first preferred embodiment of the invention, a rotary connector 10 which is shaped particularly to suit for application to a combination of a steering wheel 12 and a steering column 14 in an automobile (not shown) is illustrated in FIGS. 1 – 4. A housing 16 of this connector 10 is made of an insulating material having an adequate rigidity and shaped generally annular or doughnut-like as seen in these Figures. This shape may alternatively be defined to be cylindrical with vacant cylindrical center. The outer surfaces of the housing 16 may be either flat or curved, but the inside of a front wall **16*a* is preferably made flat and the insides of both an exterior peripheral wall 16*b* and an interior peripheral wall 16*c* should be made circular cylindrical. The rear end of the housing 16 may be left open except for local and discontinuous rear walls 16*d* formed at regions near the respective peripheral walls 16*b* and 16*c* as seen in FIGS. 2 and 3. Various current synthetic resins may serve as the insulating material for this housing 16. The housing 16 has on its front wall 16a at least one projection 18 provided with screw holes 20 for attachment to a rotatable member, for example, the steering wheel 12. An annular base plate 22 of an insulating material, for example the same material as the housing 16, is disposed in the housing 16 coaxially with the latter. The base plate 22 has such diameters that it can be rotated relatively to the housing 16 in either circumferential direction. An annular retainer 24 is coaxially disposed in the housing 16 and supported by the rear wall 16*d* and/or the exterior peripheral wall 16*b*, and another retainer 26, which also is annular but smaller in diameters than the other retainer 24, is coaxially disposed in the housing 16 and supported by the rear wall 16*d* and/or the interior peripheral wall 16c in such an arrangement (as illustrated) that the rear side of the base plate 22 is left uncovered at a central and annular region 22*a*** thereof. In other words, an annular slit 28 is formed between the two annular retainers 24 and 26. The retainers 24 and 26 have such a thickness that the base plate 22 can move vertically or longitudinally axially to a certain extent between the front wall 16a of the housing and the retainers 24 and 26. The front surface of the base plate 22 is dented somewhat in the most part thereof so as to form two annular and flatbottomed grooves 22*b*, and two annular contact plates 30 and 30′ are fixed onto the respective bottoms of the grooves 22*b* in such an arrangement that the contact plates 30 and 30′ are parallel to and spaced from the front wall 16*a* of the housing 16. The two contact plates 30 and 30′ are concentric with the annular base plate 22 but isolated or insulated from each other.

As seen in FIGS. 1 and 4, the housing 16 is provided on its front wall 16a at least one hollow projection 32 for holding therein a pair of contact pins 34 and 34′. Each contact pin 34 or 34′ has a round top 34a and a flange 36 at a middle portion thereof. The round top 34*a* passes through the front wall 16*a* and makes contact with the annular contact plate 30 or 30′. The contact pins 34 and 34′ are arranged so as to stand approximately perpendicularly on the contact plates 30 and 30′, respectively. The interior of the projection 32 is shaped such that the two contact pins 34 and 34′ are kept insulated from each other, for example, by an insulating partition 32*a*. Each contact pin 34 or 34′ is always pushed against the contact plate 30 or 30′ by means of a compression spring 38 which is installed in the projection 32 resting on the flange 36. The respective free ends of the contact pins 34 and 34′ are connected to a pair of leads 40 from, for example a generator (not shown). In the drawings the connector 10 has one more pair of contact pins 34 and 34′ held in another projection 32′ on the front wall 16a only for the sake of redundancy or attaining an extremely high reliability.

The annular base plate 22 has two vertically extending arms 42 on its rear surface at a distance from each other. Each of these arms 42 extends vertically of the base plate 22 and has an arc-shaped cross section as best seen in FIG. 2 so that the arm 42 can pass through the annular slit 28 making contact with neither of the two retainers 24 and 26. A pair of leads 44, which connect the contact plates 30 and 30′ to an element, for example an impact detector (not shown), installed on a member kept stationary relatively to the steering wheel 12. When the front projection 18 of the connector 10 is fixed to a rotatable member, the rear arm 42 is engaged with a hole, slit or cut which is formed in either a stationary member or a nearby located separate element, for example a base plate of a combination switch (not shown) installed on the steering column 14, so that the base plate 22 can be restrained from rotating together with the housing 16.

As seen from the description hereinbefore, the cylindrical housing 16 can be made comparatively short in length, so that the connector 10 can be mounted, for example, on the steering wheel 12 even when only a narrow space is left between the steering wheel 12 and an instrument panel. From a different point of view, both the contact plates 30, 30′ and the tops 34*a* of the contact pins 34, 34′ are enclosed in an almost closed chamber and protected from humidity and dust, so that the connector 10 can be used for a long period of time with an excellent reliability.

The connector 10 is fixed to a rotatable member, for example the steering wheel 12, in such an arrangement that the common longitudinal axis of the cylindrical housing 14 and the annular base plate 22 lies either on or parallel to the rotation axis of the steering wheel 12. In the installation of this connector 10 to the steering wheel 12, possible variations in the positional relationships between the steering wheel 12 and a separate and stationary member do not constitute any significant obstacle to a proper installation only if the rear arms 42 are initially rotated to a suitable position and the above-mentioned hole or slit is shaped and sized so as to allow the arms 42 to pass therethrough fairly loosely in the circumferential directions. There arises little difficulty even if the rotatable member is arranged somwhat eccentric from the rotation axis. The connector 10 is adaptable to various arrangements since the base plate 22 is not necessarily fixed to any separate member.

The operation or function of this connector 10 is quite simple. When the steering wheel 12 is rotated, the housing 16 also makes a rotational movement and causes the contact pins 34 and 34′ to slide on the contact plates 30 and 30′, respectively, with circular or arc traces. The base plate 22 remains substantially stationary, and the rounded top 34*a* of each contact pin 34 or 34′ is always pushed against the contact plate 30 or 30′ by the spring 38. Naturally, the electric connection between the moving leads 40 and the stationary leads 44 can be maintained during rotation of the steering wheel 12.

The contact pins 34 and 34′ can run or slide on the respective contact plates 30 and 30′ quite smoothly even if the housing 16 is forced to rotate not perfectly in a horizontal plane since the base plate 22 is allowed to make a vertical movement to a certain extent within the housing 16. It will be understood that the retainers 24 and 26 may be omitted if the interior height and bottom shape of the housing 16 are designed appropriately.

To secure the continuous contact of the contact pins 34 and 34′ with the contact plates 30 and 30′, a cantilever mechanism may be employed instead of the compression springs 38. In either case, the contact pins 34 and 34′ may be made of a magnetic material while the contact plates 30 by a material easily attracted by a magnet, or vice versa.

Since the contact pins 34 and 34′ run or slide a considerably long distance on the contact plates 30 and 30′ during repeated operations, it is desirable to take a certain measure for the prevention of an excessive wear of the rounded top 34*a*. Accordingly, the contact plates 30 and 30′ are preferably coated with a quite thin film of a conventional antiwear grease, which is indicated by the numeral 46 in FIG. 4. When the antiwear grease 46 is employed, it is important that the grease 46 is maintained always as a quite thin and uniform film so that the contact resistance between the contact plates 30, 30′ and the tops 34*a* of the contact pins 34, 34′ may not vary during operation. For the maintenance of such a state of the grease 46, the contact plates 30, 30′ are preferably equipped with at least one scraper 48 as shown in FIGS. 7 and 8, so that an accumulated grease 46 can be scraped off and wiped evenly. The scraper 48 is made of a insulating material which exhibits an adquate elasticity over a wide temperature range and may be selected from various currently available plastics. The scraper 48 is partly inserted into a holder 50 so as to leave a flate face 48*a* exposed as seen in FIG. 7. The holder 50 is fixed to the inside of the cylindrical housing 16 in such an arrangement that the flat face 48a makes an intimate contact with the contact plates 30 and 30'. The scraper 48 is positioned close to the contact pins 34, 34' and arranged generally radially of the contact plates 30, 30'. It is preferable to arrange two sets of the scrapers 48 so as to stand respectively in the circumferential and opposite directions with respect to the contact pins 34, 34' as seen in FIG. 8.

Referring to FIG. 5, it is permissible to fix the cylindrical housing 16 to a stationary member, for example the steering column 14, and rotate the base plate 22 together with the steering wheel 12 by means of a plurality of the rear arms 42 and corresponding guide members 12*a* fixed to the steering wheel 12.

When the connector 10 has two pairs of the contact pins 34, 34' as shown in FIG. 6, each of the one pair and one of the other pair will slide along the same circular trace on the contact plate 30 or 30' if the contact pins 34, 34' are arranged in the center of the annular contact plates 30, 30' and the rotation angle of the housing 16 exceeds a value which is depending on the circumferential distance between the two sets of the contact pins 34 — 34 or 34' — 34'. Such a condition is unfavorable for maintaining an intimate contact of each contact pin 34 or 34' with the contact plate 30 or 30' and for avoiding wear of the contact plates 30, 30'. In a modfication in FIG. 6, a radial distance $L_1$ between the longitudinal axis A of the cylindrical housing 16 and the outer contact pin 34 of the first pair is a little differentiated from a distance $L_1'$ between the axis A and another contact pin 34 which is arranged on the same contact plate 30 as the above-mentioned contact pin 34, so that the trace of the former contact pin 34 never coincides with nor intersects the trace of the latter contact pin 34. The remaining or inner contact pins 34' of the respective sets are arranged in the same manner so as to have different distances $L_2$ and $L_2'$ from the axis A, respectively.

What is claimed is:

1. A device for providing electric connection between an element attached to a rotatable member and another element attached to a stationary member, comprising:

a cylindrical housing of an insulating material with vacant cylindrical center;

an annular base plate of an insulating material coaxially disposed in said housing in such an arrangement that said base plate is movable within said housing both in circumferential directions and in longitudinal axial directions;

first and second annular contact plates spaced from each other and placed fixedly and coaxially on a first face of said base plate;

first and second contact pins disposed in said housing in such an arrangement that said first and second contact pins are in contact with said first and second contact plates, respectively, and extend therefrom substantially perpendicularly to said contact plates; and means for urging said contact pins to be always pushed against said contact plates, respectively, even when said base plate moves within said housing;

said housing being locally shaped and said base plate having at least one vertical arm extending outwardly of said housing such that one of said housing and said base plate can be fixed to said rotatable member and the other can be engaged with said stationary member such that the latter one is restrained from rotating together with said former one.

2. A device as claimed in claim 1, wherein said housing has at least one locally and axially projecting hollow projection, said hollow projection extending from a front wall of said housing, said front wall facing said contact plates, said contact pins passing through said front wall, and said means consist of two compression springs installed in said hollow porjection such that each of said compression springs always pushes one of said contact pins against one of said contact plates.

3. A device as claimed in claim 2, wherein said arm of said base plate extends from a second face thereof reverse to said first face in a direction parallel to the longitudinal axis of said housing and has a cross section of an arc shape.

4. A device as claimed in claim 3, further comprising a first annular retainer and a second annular retainer having diameters smaller than the smaller diameter of said first retainer, said first and second retainers being coaxial with said housing and disposed in said housing such that said second face of said base plate is opposite to said retainers and that said arm of said base plate passes through a gap formed between said first and second retainers.

5. A device as claimed in claim 1, wherein each of said contact pins is rounded at an end thereof, said end making contact with one of said contact plates.

6. A device as claimed in claim 1, wherein a contact face of each of said contact plates is coated with a thim film of an antiwear grease.

7. A device as claimed in claim 6, further comprising two scrapers of an insulating and elastic material, said scrapers being fixed to said housing and shaped and arranged such that each thereof is in contact with said contact faces of said first and second contact plates and that said first and second contact pins are interposed between said two scrapers in the circumferential direction of said contact plates.

8. A device as claimed in claim 1, further comprising another pair of contact pins which are identical with said first and second contact pins for the sake of redundancy, said another pair of contact pins being arranged separate from and similarly to said first and second contact pins, each of said first and second contact pins and said another pair of contact pins being arranged in such an arrangement with respect to said first and second contact plates that a trace of said each contact pin on one of said contact plates formed when one of said housing and said base plate is rotated is always isolated from the traces of the other contact pins.

* * * * *